United States Patent [19]

Okajima et al.

[11] Patent Number: 5,020,282

[45] Date of Patent: Jun. 4, 1991

[54] GRINDING TOOL AND METHOD OF MAKING THE SAME

[75] Inventors: Hiroshi Okajima; Susumu Sudo, both of Nagoya, Japan

[73] Assignees: Sankyo Rikagaku Co., Ltd., Tokyo; Takekawa Tekko Kabushiki Kaisha, Aichi, both of Japan

[21] Appl. No.: 299,041

[22] Filed: Jan. 19, 1989

[30] Foreign Application Priority Data

Apr. 2, 1988 [JP] Japan ..... 63-81879

[51] Int. Cl.[5] ..... B24D 9/00

[52] U.S. Cl. ..... 51/206 R; 51/207; 51/358; 51/395

[58] Field of Search ..... 51/206 R, 206 P, 207, 51/358, 363, 381, 395; 428/34.9, 35.1

[56] References Cited

U.S. PATENT DOCUMENTS

| | | | |
|---|---|---|---|
| 2,049,874 | 8/1936 | Sherk | 51/206 P |
| 2,292,261 | 8/1942 | Albertson | 51/395 |
| 3,364,630 | 1/1968 | Rusk et al. | 51/358 |
| 3,448,546 | 6/1969 | Windecker | 51/358 X |
| 4,177,611 | 12/1979 | Carr-Rollett | 51/358 X |
| 4,325,998 | 4/1982 | Chapman | 428/34.9 |
| 4,611,438 | 9/1986 | Siden | 51/206 R |
| 4,682,446 | 7/1987 | Woodall et al. | 51/395 X |

*Primary Examiner*—Robert Rose

*Attorney, Agent, or Firm*—Bauer & Schaeffer

[57] ABSTRACT

A grinding tool wherein a thermocontrating tube on which is formed a partial layer pattern in which parts having no abrasive are scattered and separated, the abrasive part is applied to cover the peripheral surface of a shaped base and is then heated to closely adhere to the surface of the base.

7 Claims, 6 Drawing Sheets

(I)

(II)

(III)

(IV)

(V)

(VI)

GRINDING TOOL AND METHOD OF MAKING THE SAME

FIELD OF THE INVENTION

This invention relates to a grinding tool and method of making such tool for cutting and grinding workpieces of wood or metal and a method of making the same and is characterized by being adapted in particular to a tool for cutting and grinding a workpiece of complicated shape, particularly having a curved surface.

BACKGROUND OF THE INVENTION

In order to cut and grind wooden surfaces of complicated shape such as a curved surface on the peripheral edge of the workpiece, it has been generally necessary to use a pressure pad provided with a surface corresponding to the surface to be ground and which is arranged inside a sanding belt so as to press the sanding belt against the workpiece. However, since the pressure pad must be pressed against the sanding belt under tension to adapt the sanding belt to the surface to be ground, if the surface is a complicated curved surface, the adapting action will not be favorable or true. As a result, the surface of the work will be scraped away at the end edges by the upper and lower edges of the sanding belt.

In order to improve the action of the foregoing arrangement, a shaping base having a contoured surface, conformed to the surface to be formed on the workpiece, is provided with small pieces of sanding paper having an abrasive grain layer formed on the outer surface. The pieces are pasted, one by one, along the axis, on the peripheral surface of the shaping base to form a grinding surface which can then be pressed against the workpiece while the shaping base is rotated.

However, in such construction it is necessary to uniformly paste the sandpaper pieces on the entire peripheral surface of the base. Thus, when they are worn, it is necessary to peel these pieces off one by one and then to re-paste small pieces of new sanding paper. Thus, the workability of the grinding device is very low.

The foregoing technical problem is the same also in working metals. It is difficult to make an abrasive surface in a complicated shape and to replace the abrasive surface in a complicated shape and replacing the abrasive surface particularly since it is difficult to form the same abrasive grain layer as in the original surface.

The present invention has it as an object the provision of a grinding tool that is easy to make and a method for making the same.

SUMMARY OF THE INVENTION

In the grinding tool of the present invention, a shaping base is provided with a contoured surface conforming to the shape of the surface to be ground. The surface is coated on its exterior with a heat-shrinkable tube on which a pattern is applied in which scattered parts have an abrasive layer and other parts are free of abrasive.

In this partial abrasive pattern, numerous independent abrasive patches are scattered or many band-like strips of abrasive patches are laid in parallel.

This grinding tool can thus be easily made by the following steps;

a) providing a shaping base with a contoured surface conforming to the shape of a surface to be ground;

b) placing a heat-shrinkable tube of a predetermined dimension over a jig;

c) depositing on the surface of the tube, a bonding agent in a uniform thickness and in a predetermined array of patches separated by areas free of the bonding agent;

d) blowing abrasive grains onto the peripheral surface of the heat-shrinkable tube to cause the abrasive grains to bond to the predetermined pattern of the bonding agent;

e) allowing the bonding agent and abrasive grains to dry and thereafter coating the surface of the heat-shrinkable tube with a protective resin;

f) subsequently removing the heat-shrinkable tube from the jig; and g) applying the heat-shrinkable tube to the shaping base and finally heating the heat-shrinkable tube to cause it to contract and closely adhere to the surface of the shaping base.

BRIEF DESCRIPTION OF THE DRAWINGS

FIG. 6(I) to 6(VIII) are views showing the steps according to the present invention for producing the grinding tool.

DETAILED DESCRIPTION OF THE INVENTION

Figure 1:
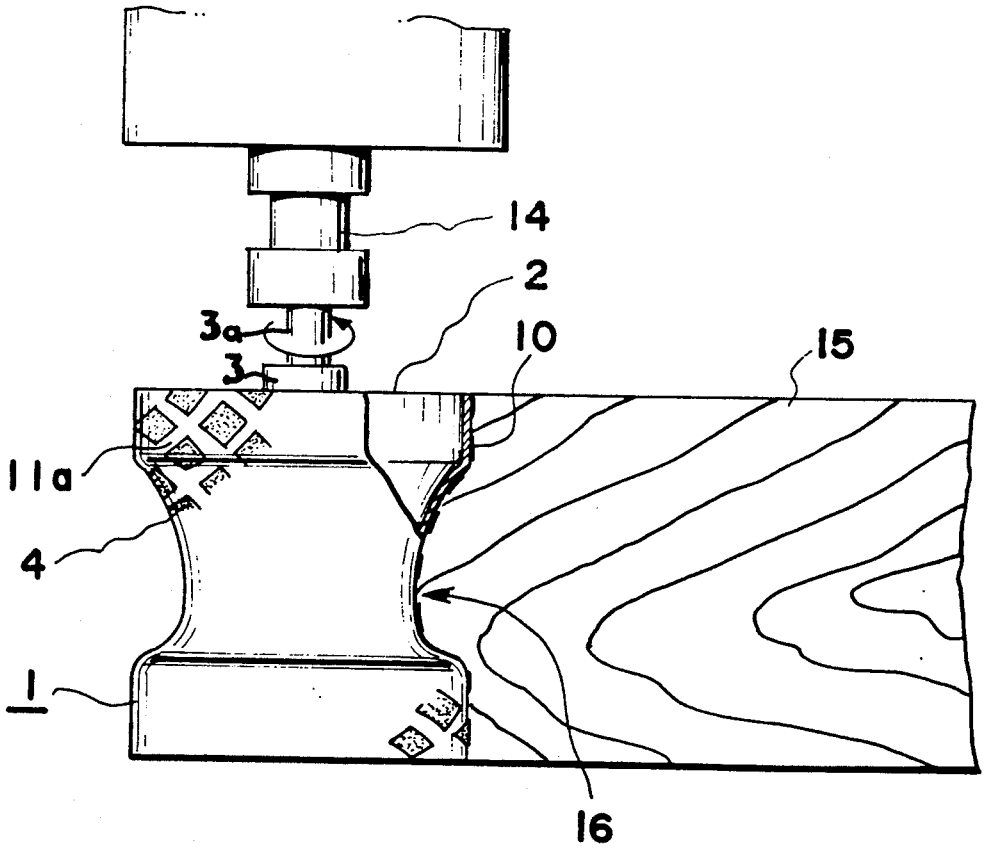
FIG. 1 is a partly sectioned elevational view showing a grinding tool embodying the present invention.
Figure 2:
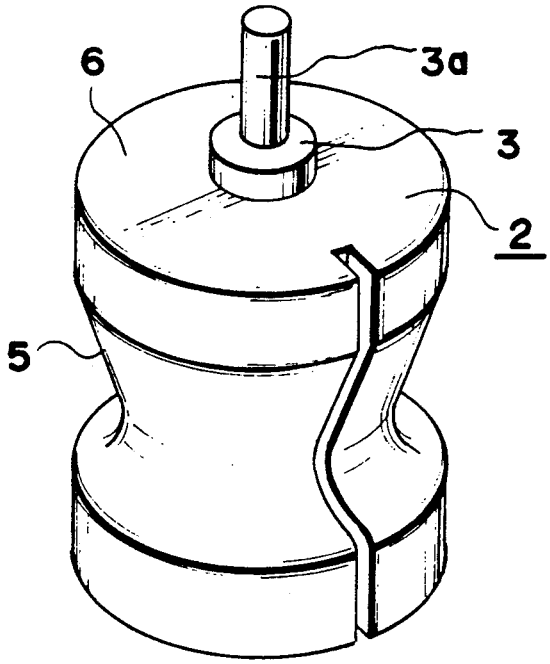
FIG. 2 is a perspective view of a shaping base of FIG. 1.

In FIGS. 1 and 2 a wheel-like grinding tool is formed by covering the Outer-surface of a cylindrically shaped base 2 with a thermocontracting or heat-shrinkable tube 10. The base 2 is arranged on the grinding machine for working wood or the like by a supporting shaft 3*a* integral with a metal core 3. The shaft 3*a* is coupled to a driving shaft 14 of a conventional grinding or sanding machine so that its grinding surface 4 can be rotated against the work surface 16 of a workpiece 15.

Figure 3:
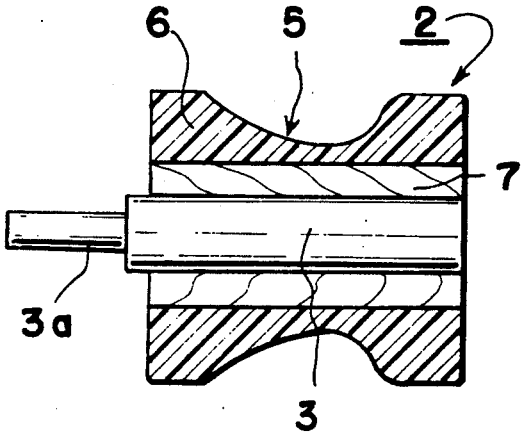
FIGS. 3 and 4 are vertically sectioned side views respectively showing embodiments of the shaping base of FIG. 1.
Figure 4:
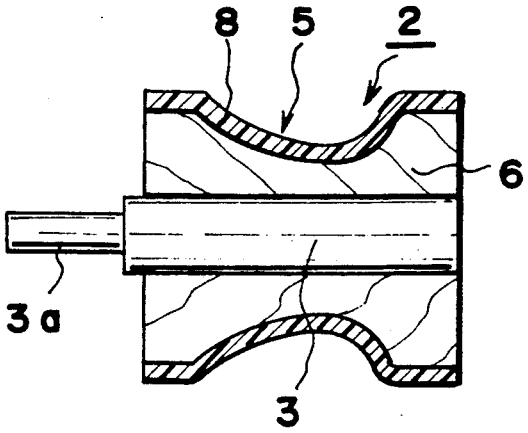

As shown in FIGS. 2 to 4, the base 2 is provided with a contoured surface 5 conforming to the shape of the work surface 16 of the workpieces 15. It is preferably formed by molding a body 6 made of such moldable material as wood, rubber, resin, non-metal over to the core metal 3.

When it is necessary to give proper elasticity to the surface of the base 2, so as to improve the close contact with the surface of the workpiece, the body 6 may be formed of a synthetic rubber or resin material. As shown in FIG. 3, a rigid core 7 may be provided on its peripheral surface with a soft pad 8 made of synthetic rubber or sponge. Still as shown in FIG. 4, thin small pad pieces 8 of synthetic rubber or sponge may be bonded parallelly in the axial direction on the peripheral surface of the body 6.

As seen in FIG. 1, a thermocontracting or heat-shrinkable tube 10 is applied in close contact on the outer surface of the shaping base 2. A plurality of discrete patterns 11*a* of abrasive and abrasive patches 12*a* are applied to the surface of the tube and the surrounding areas 13*a* left free of abrasive. In this manner, a pattern of sanding or grinding material is layered on the exterior of the tube 10. The pattern may be random and scattered or it may have a patterned array.

FIGS. 5(I) and (IV) show embodiments of abrasive patterns 11*a* to 11*d* wherein numerous independent patches of abrasive grain layers 12*a* to 12*d* are spotted over the peripheral face of the heat-shrinkable tube. The figures are shown as developed views respectively with the vertical direction as the axial direction of the tube 10.

The pattern 11*a* shown in FIG. 5(I) is made like a lattice by arranging a plurality of areas 13*a* having no adhesive at regular intervals in directions inclined by 45 degrees to form square independent abrasive patches 12*a*.

Figure 5:
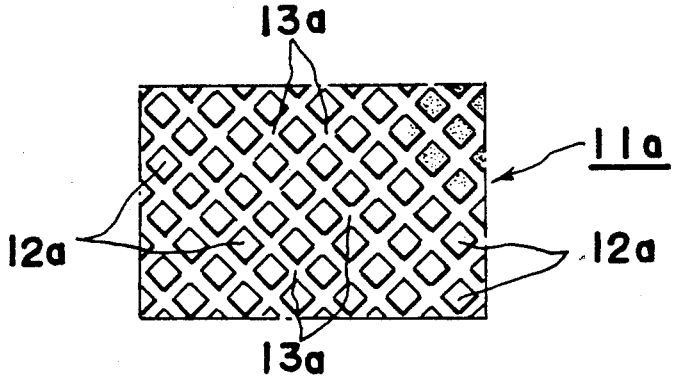
FIG. 5(I) to (VI) are developed views of distinct and partial abrasive grain layer patterns.
Figure 5:
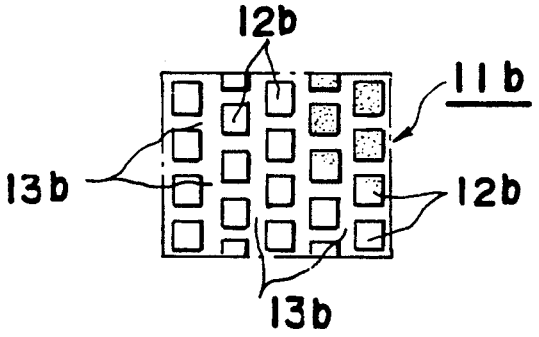
Figure 5:
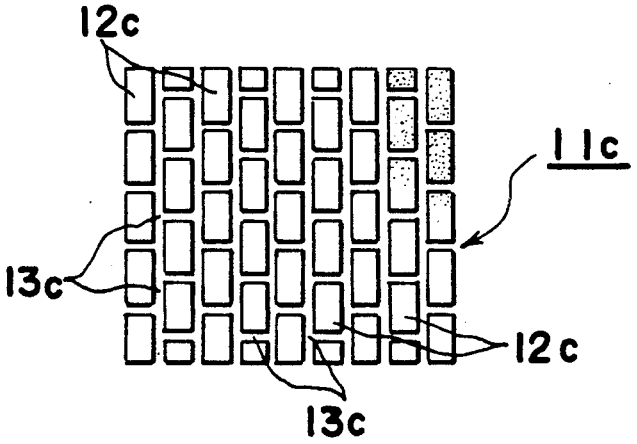
Figure 5:
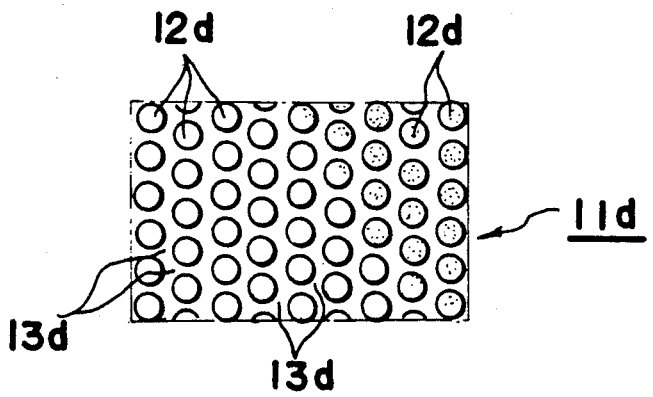
Figure 5:
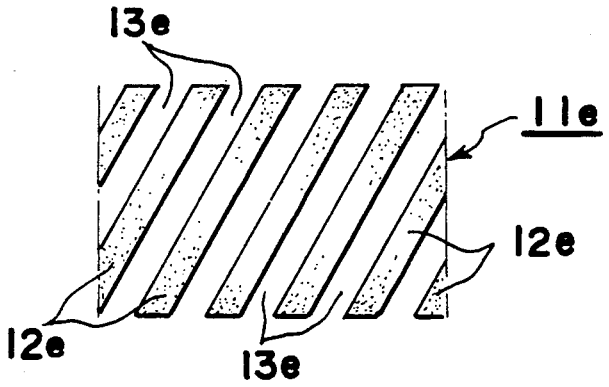
Figure 5:
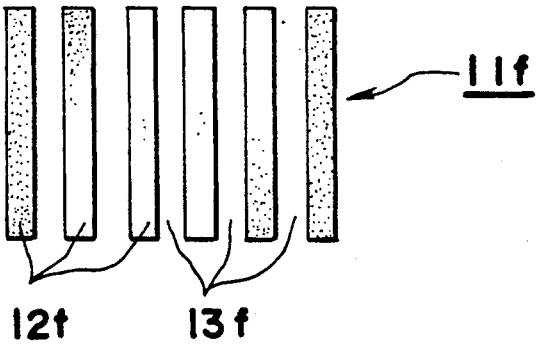

In the pattern 11*b* shown in FIG. 5(II), square independent patches 12*b* are arranged in the axial direction but are checkered, i.e. staggered, in the circumferential direction and areas 13*b*, having no abrasives, are formed around the respective patches 12*b*.

In the pattern 11*c* shown in FIG. 5(III), rectangular independent patches 12*c* are arranged like laid bricks and fine groove-like areas 13*c* free of abrasive are formed around the respective patches.

In the pattern 11*d* shown in FIG. 5(IV) circular independent, abrasive patches 12*d* are arranged and areas 13*d* having no abrasive are formed around them. By the way, the patches 12*d* may be elliptical.

Other shapes of patches such as a triangle, diamond and polygon can be used and various arrays of these patches can be also made.

The rate of shrinkage of the tube 10 during its application to the shaped base 2 is different in the respective different parts of the tube due to the curvature of the contoured surface 5 of the shaped base 2. For example, the heat shrinkable tube 10 contracts differently in the peripheral direction than in the axial direction. Furthermore, those parts of the tube 13*a* to 13*d* free of abrasive have relatively lower resistance and are more likely to expand and contract than the portions of the tube having abrasive patches 12*a* to 12*d*. Therefore, those parts 13*a* to 13*d* contract more swiftly and greater in the peripheral direction and axial direction than the rest of the tube 10. Therefore, the bonding agent layer itself on which the respective adhesive patches 12*a* to 12*d* are formed do not have the same contracting burden and, therefore, will not peel off. The heat shrinkable tube 10 can, therefore, adhere closely to the peripheral surface of the shaped base 2.

FIGS. 5(V) and (VI) show patterns 11*e* and 11*f* made of many parallelly arranged band-like patch strips of abrasive 12*e* and 12*f*.

In the pattern 11*e* shown in FIG. 5(V), strips of patches 12*e* are inclined by about 30 degrees to the axis and parallelly arranged. The parts 13*e* free of abrasive are inclined by the same angle and separate the respective strip 12*e*. Even in such formation the free parts 13*e* can contract in the peripheral direction and in the axial direction due to the inclination and the abrasive patch 12*e* does not peel off.

In the pattern elf shown in FIG. 5(VI), the band-like patches 12*f*, parallel in the axial direction, are spaced at predetermined intervals in the peripheral direction between areas 13*f*. The shrink rate in the peripheral direction is so much larger than in the axial direction that, even in this arrangement, the expected effect of preventing the patches 12*f* from being peeled off will be able to be attained. (It may be desirable to provide contraction in the axial direction. This is also possible by suitably arranging the patches.)

In other modifications, the strips may be inclined in the reverse direction, they may be overlapped and crisscrossed in the inclined, as well as the axial or horizontal directions and made to form various patterns.

In the patterns 11*a* to 11*d*, where the portions 13*a* to 13*d* having no abrasive are more uniformly dispersed over the entire peripheral surface of the heat shrinkable tube 10, there is an advantage in that the tube 10 can be more uniformly contracted.

On the other hand, the array produced in each of the patterns 11*e* and 11*f*, where the respective band-like abrasive patches 12*e* and 12*f* are arranged in parallel, has the advantage that abrasive material can be secured over a large area. It will also be easier to transfer the adhesive in the process described hereinafter.

The process for producing the grinding tool of the present invention is explained in the following with reference to FIG. 6. As seen in FIG. 6(I), the heat shrinkable tube 10 is cut to be of a predetermined length and a columnar (e.g. cylindrical rod) jig 20 made of steel or such resin as Teflon is fitted into the tube 10. The jig 20 is made equal in its outside diameter to the inside diameter of the tube 10 and is smoothly finished on its surface to make it easy to insert into the tube. By the way, as mentioned later, a mold separating layer may be formed in advance on the peripheral surface of the jig 20 so that it may be easy to remove the tube 10 from the jig 20.

Figure 6:
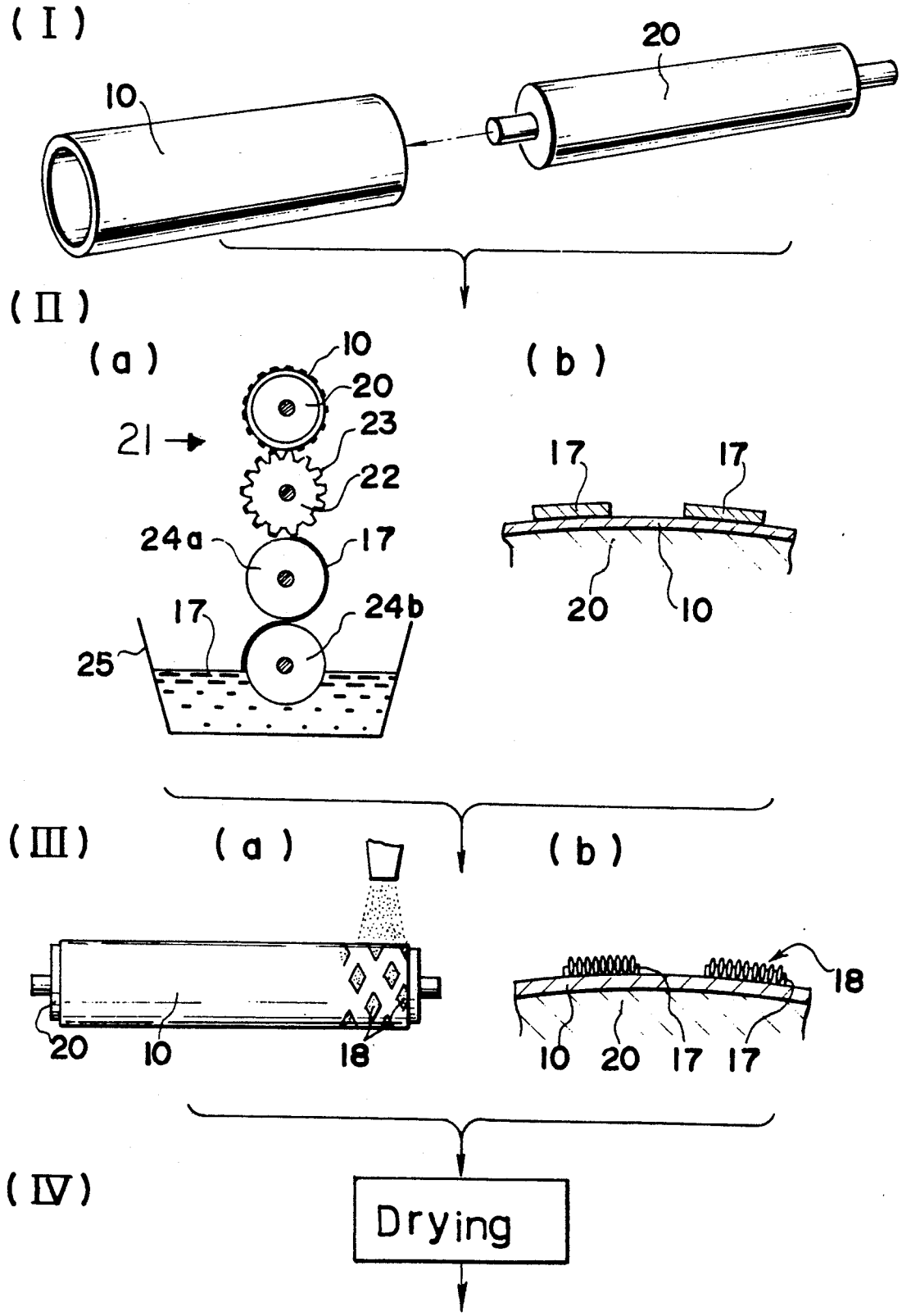
Figure 6:
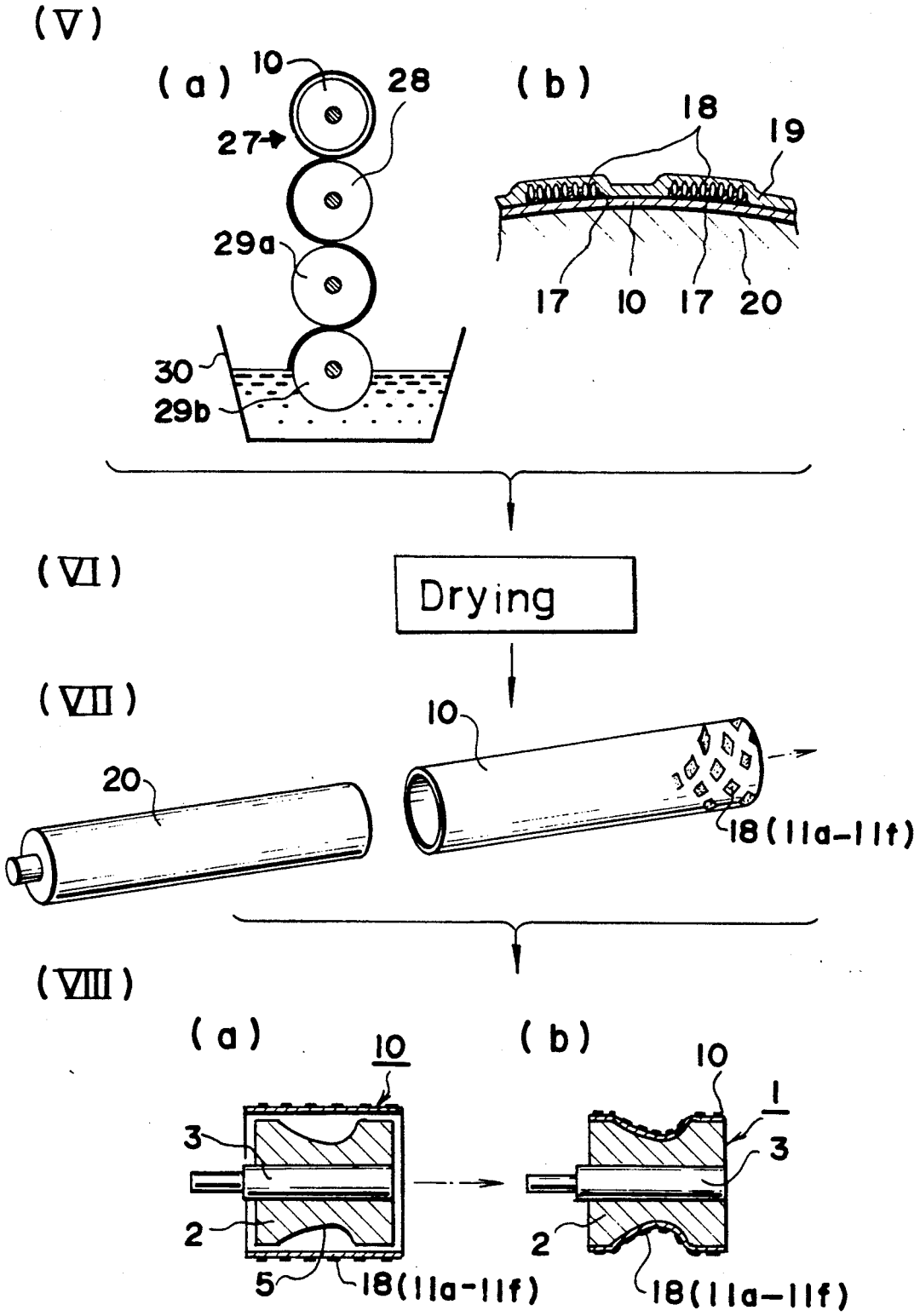

In FIG. 6(II)(a), the reference numeral 21 represents a transferring apparatus for forming a pattern of a bonding agent on to the peripheral surface of the tube 10. This transferring apparatus 21 comprises a transfer roll 22 having a plurality of projecting molds 23 arranged in the same pattern as a selected one of patterns 11*a* to 11*f* to be formed on its peripheral surface. The molds 23 arranged to receive a liquid bonding agent 17 from reservoir 25 via feeding rolls 24*a* and 24*b* the bonding agent 17 is deposited in a uniform thickness on the peripheral surface of the roll 22 which is pivoted through a rotation controlling mechanism (not illustrated) and subsequently deposited on the tube 10. The bonding agent 17 is an epoxy resin or the like. The transfer roll 22 is equal in outside diameter to the heat shrinkable tube 10 supported on the jig 20. The jig 20 has stub shafts at both ends so as to be supported to permit the tube 10 externally contact the transfer roll 22 and is rotated by one rotation in synchrony with the transfer roll 22 by the rotation controlling mechanism. Thereby, the bonding agent 17 within the liquid tank 25 is squeezed by the feeding rolls 24*a* and 24*b* to a predetermined thickness, is rolled and deposited on the projecting molds 23 and eventually transferred in the same pattern onto the peripheral surface of the tube 10 as shown in FIGS. 6(II)(b).

The patterns made on the transfer roll 23 may be easily produced, for example, by machining crossed spiral grooves conforming to the array of free areas 13*a*–13*f*, along the length of the roll as seen in FIG. 6(III)(*a*) or by machining grooves spaced axially along the roll by intermittently feeding the roll, in the axial direction. Any conventional method of embossing or otherwise working the surface of the transfer roll 23 may be employed.

The jig 20, holding the tube 10, is removed after application of the adhesive from the transfer apparatus 21 and, as shown in FIG. 6(III)(*a*), abrasive grains are blown onto the pattern of the bonding agent 17 by an electrostatic coating mechanism or by simply dropping the grains thereon before the bonding agent dries. Thereby, as shown in FIG. 6(III)(*b*), the abrasive grains are bonded to the bonding agent 17 and grain layers 18 of the predetermined pattern is formed.

The tube 10 on which the abrasive grain layers 18 are formed and which is supported by the jig 20 is thereafter dried by an air drier at about 120 degrees C. for about 30 to 60 minutes (FIG. 6(IV)). Even if dried at a higher temperature, as the tube 10 is held by the jig 20 of equal diameter, there will be no trouble.

After this drying, the exterior coating of resin layer 19 is applied on the entire periphery of the tube 10 by the transferring apparatus 27 as shown in FIG. 6(V)(*a*). The transferring apparatus 27 is of the same formation as of the transferring apparatus 21 for transferring the bonding agent and comprises a transfer roll 28, feeding rolls 29*a* and 29*b* and a liquid resin tank 30. The tube 10, supported by the above mentioned jig 20, is externally contacted with the transfer roll 28 and the tube 10 having the abrasive 18 is coated on its entire surface with a resin. Thereby, as shown in FIG. 6(V)(*b*), the abrasive patches 18 are covered with the resin layer 19 to be stably held on the surface of the tube 10, resistive to any frictional force prior to the time of grinding.

The tube 10 is thereafter removed from the transferring apparatus 27, dried the same way as above and is removed from the jig 20 (FIG. 6(VII)).

This surface treated tube 10 is long in the axial direction, and may, therefore, be cut to be of a length substantially equal to that of shaped base 2. When needed, it is then externally fitted to the shaped base 2 as shown in FIG. 6(VIII)(*a*) and subsequently heated and contracted as in FIG. 6(VIII)(*b*) so as to closely adhere to the surface of the base 2. Heating may be effected by passing the tube 10 through a furnace, dipping it in warm water, or roasting it with fire. The parts 13*a* to 13*f* of the tube 10, free of abrasive, contract so well and quickly as not to force the sections having abrasive patches 12*a* to 12*f* to contract, and, therefore, the patches are not subjected to peeling or removal.

The grinding tool 1 need not always be cylindrical or roll-like, but may be constructed to be planar or movable reciprocally relative to the workpiece (i.e. for use in a reciprocating sander) and thus, for example, be of a rectangular cross-section. Grinding tools in a wide range can be formed by the present invention for use on such various materials as a wood, metal, or resin.

The heat shrinkable tube in each of the above mentioned embodiments has the characteristic of quickly contracting in diameter, at a temperature of 70 to 130 degrees C. Therefore, when a shaped base having a preformed contoured surface is covered with a preformed tube and is heated, a finished grinding tool is made.

By contrast, should it be attempted to apply a layer of the bonding agent over the entire surface of the tube and thereafter apply the abrasive grains, then several problems might arise, since the adhesive has a rate of shrinkage different from that of the tube material itself and is hard to shrink. Therefore, such a coated tube would be difficult to adhere over a contoured base having sections, the diameters of which are smaller than the inside diameter of the tube where substantially great amounts of shrinkage is required. As a result, the tube will defectively adhere to the contoured base and will easily separated therefrom, peel off in use and foul the workpiece. As a result downtime will increase and the yield rate will not be reduced.

On the other hand, in the present invention, the partial abrasive layer pattern in which the abrasive is scattered, allow those parts without bonding agent or abrasive to shrink fully and greatly on the base, even though the other parts with abrasive have greater resistance to shrinkage. Therefore, the burden on the expansion and contraction of the bonding agent layer portions will be reduced and the tube will closely adhere to the contoured surface of the shaping base without peeling or weaken the abrasive grain layers.

Also, the above mentioned method makes it easy to provide grinding tools with this partial abrasive layer pattern. By using a transferring apparatus having a transfer roll with the same pattern as the pattern to be projected on the peripheral surface of the tube and a feeding roll assembly for depositing the bonding agent in a uniform thickness thereon. Mounting the tube on a cylindrical jig ensures that the tube is externally contacted by the transfer roll and is synchronously rotated to form the desired pattern on the outer surface of the tube. Further, by blowing the abrasive grains onto the pattern of bonding agent patches, the abrasive grain layers are formed in a predetermined pattern. Coating the tube with an exterior layer of resin seals the abrasive grain layers and protects the tool.

What is claimed is:

1. A grinding or sanding tool for working shaped objects comprising a rigid base having a shaped surface for forming the object, a heat shrinkable tube disposed freely over said base and being heat shrunk to conform to the shape of said base, the outer surface of said tube having discrete portions of adhesive material in which is held an abrasive, said discrete portions being arrayed in a selected pattern separated by surface portions of said tube free of abrasive and adhesive so that the differences in shrinkage therebetween cause said tube to contract into the exact shape of said base.

2. The grinding or sanding tool according to claim 1, wherein said abrasive and adhesive portions are arrayed in parallel spaced bands.

3. The grinding or sanding tool according to claim 1, wherein said abrasive and adhesive portions are arranged in a grid array.

4. The grinding or sanding tool according to claim 3, wherein said portions are rectangular.

5. The grinding or sanding tool according to claim 3, wherein said portions are circular.

6. The grinding or sanding tool according to claim 3, wherein said portions are diamond shaped.

7. A grinding or sanding tool according to claim 1, including a layer of material interposed between said base and said tube, said interposed layer being more rigid than said tube and less rigid than said base.

* * * * *